US005279009A

United States Patent [19]

Putka, Jr.

[11] Patent Number: 5,279,009

[45] Date of Patent: Jan. 18, 1994

[54] BED SHEET WITH STORAGE POCKETS

[76] Inventor: David L. Putka, Jr., 2710 Thicket Rd., Soddy Daisy, Tenn. 37379

[21] Appl. No.: 103,441

[22] Filed: Aug. 6, 1993

[51] Int. Cl.[5] ..... A47G 9/04

[52] U.S. Cl. ..... 5/485; 5/497

[58] Field of Search ..... 5/485, 482, 497, 495, 5/931, 462

[56] References Cited

U.S. PATENT DOCUMENTS 5,111,544 5/1992 Graebe ..... 5/485

FOREIGN PATENT DOCUMENTS 2617031 12/1988 France ..... 5/485

2173095 10/1986 United Kingdom ..... 5/485

2198348 6/1988 United Kingdom ..... 5/485

*Primary Examiner*—Alexander Grosz

*Attorney, Agent, or Firm*—Alan Ruderman

[57] ABSTRACT

A fitted bed sheet having a storage pocket at each side wall at a location readily accessible to a person while in bed. A closure in the form of a zipper closes the top of the pocket while a lock may secure the zipper in the closed condition. A flap is pivotably connected above the pocket to overlay and conceal the zipper.

4 Claims, 2 Drawing Sheets

BED SHEET WITH STORAGE POCKETS

BACKGROUND OF THE INVENTION

This invention relates to bed sheets, and more particularly to bed sheets having at least one storage pocket formed at a side thereof.

Frequently it is desirable to store articles at bedside in a secure location. If, for example, such articles or objects are located on a night stand or the like adjacent to a bed, the object is unnecessarily accessible to uninvited persons such as a child, an intruder or other uninvited persons such as a burglar. For example, with the high crime rate in society, some persons do not feel comfortable going to bed without some protective device such as a can of disabling spray or firearm. Clearly, devices such as these should be maintained in a secure location and not be readily available to the unwelcomed visitor or a child. However, if the device is locked away, it is not readily available when needed. It is thus desirable to provide a storage location for storing such articles, objects or devices for ready accessibility to a person while in bed but which is secure against intruders.

SUMMARY OF THE INVENTION

Consequently, it is a primary object of the present invention to provide a bed sheet for covering the mattress on a bed, the bed sheet having at least one storage pocket formed for retaining articles which are desired to be readily available to a person in the bed.

It is another object of the present invention to provide a bed sheet for covering the mattress on a bed, the bed sheet being formed with at least one storage pocket at a side thereof for retaining selective articles in a convenient location to a person in bed.

It is a further object of the present invention to provide a bed sheet with closable storage pockets at the sides thereof adjacent one end for securely retaining desirable articles at a location readily accessible to a person in bed.

Accordingly, the present invention provides a bed sheet, which may be a fitted sheet, positionable about a mattress on a bed, the bed sheet having at least one storage pocket connected thereto at a location which is readily accessible to a person while in bed. Each storage pocket is located at a side of the bed sheet adjacent one end of the sheet so as to be adjacent the location where the upper body of the person is located when prone on the bed. There may be a pocket at each side of the bed sheet for increased storage capacity. Preferably each pocket includes a closure so that articles may be securely and safely stored. Additionally, it is preferred to have a covering or flap to conceal the closure from view to provide increased security.

BRIEF DESCRIPTION OF THE DRAWINGS

The particular features and advantages of the invention as well as other objects will become apparent from the following description taken in connection with the accompanying drawings in which.

DESCRIPTION OF THE PREFERRED EMBODIMENT

Figure 1:
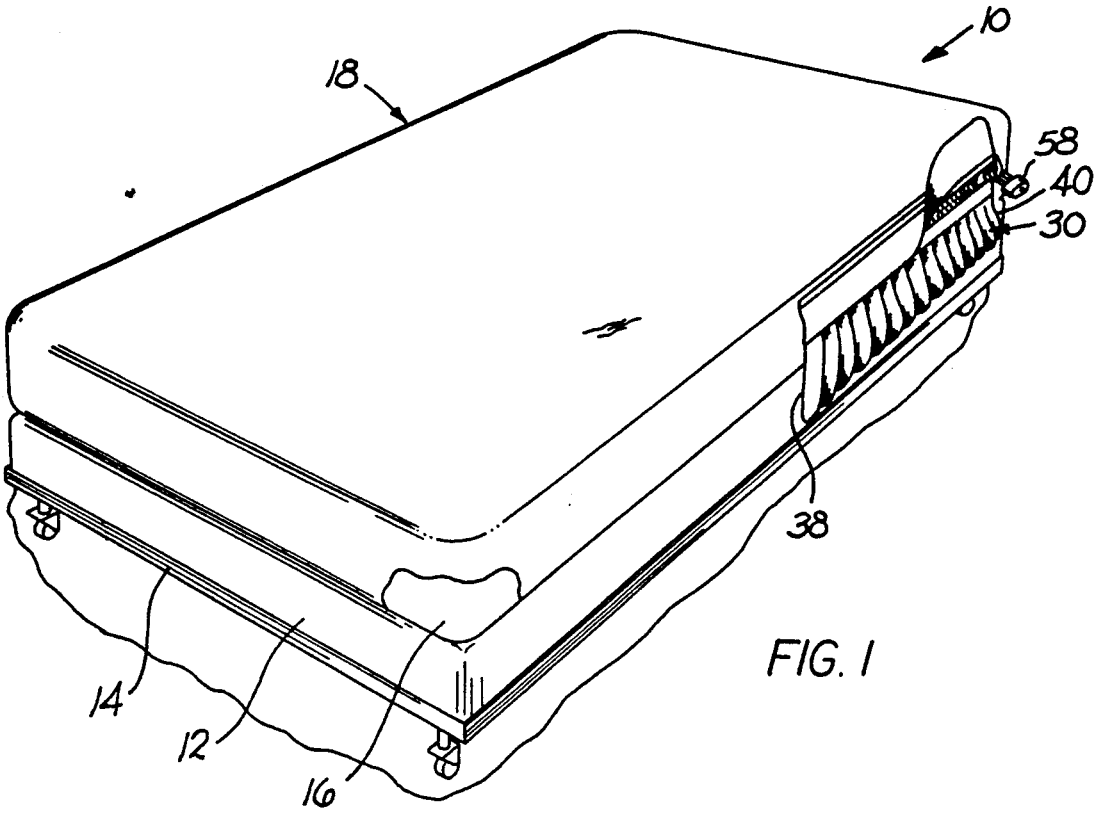
FIG. 1 is a perspective view illustrating a bed sheet constructed in accordance with the present invention fitted on a bed.
Figure 2:
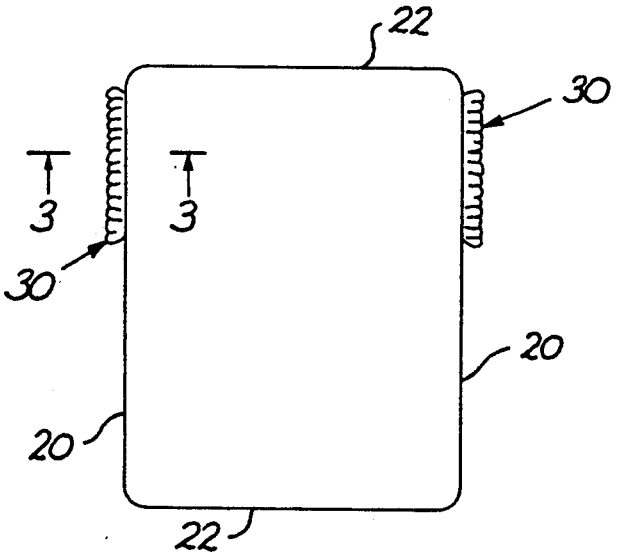
FIG. 2 is a top plan view of the bed sheet illustrated in FIG. 1.
Figure 3:
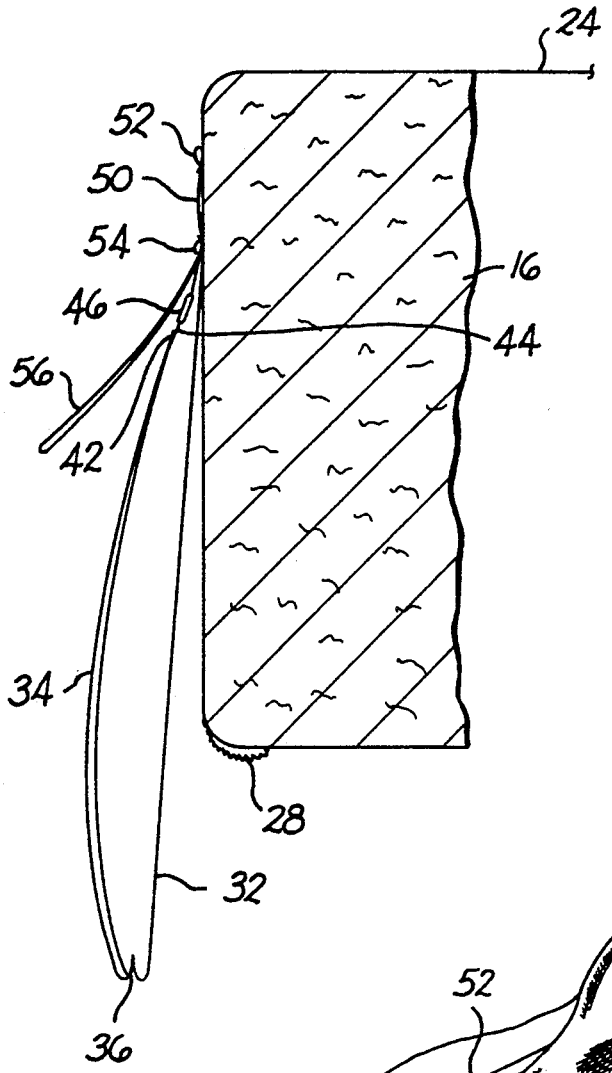
FIG. 3 is a cross sectional view taken substantially along line 3—3 of FIG. 2.

Referring now to the drawings, a bed is generally indicated at 10 in FIG. 1, the bed conventionally including a box spring 12 supported by a frame 14, and a mattress 16 disposed on the box spring. Fitted about the mattress 16 is a bed sheet 18 constructed in accordance to the present invention, the sheet being fabricated from conventional material such as cotton or similar fabric material and preferably being a form fitted sheet having formed sides 20 and ends 22 depending from the upper surface 24, and having elastic material 28 at the junction of the sides 20 and the ends 22 remote from the upper surface 24 so as to fit snugly about the mattress in conventional manner.

Fastened to the sheet 18, preferably at each side 20, in accordance with the present invention, is a storage pocket 30, each pocket being in the form of a pouch formed from fabric materials such as that from which the sheet is constructed. Each pocket may comprise a first ply 32 of fabric sewn to the side 20 of the bed sheet and folded so as to form a second ply overlaying the first ply with the two plies sewn together at the ends. However, it is preferred to provide the pockets with a more aesthetic look and thus a pleated face 34 forming the second ply of the pocket is sewn to the ply 32 along a bottom edge 36 by stitching or the like and, of course, along edges 38, 40 of the ply 32 and the face 34 of each pocket. To close the pocket for securing articles therein out of sight and for security, the upper edge 42 of the pleated face 34 is sewn to one of the attachment bands 44 of a zipper 46 or other closure member such as a hook and loop fastener or the like, the attachment band forming half of the zipper assembly. The other half or band 48 of the zipper 46 may be sewn directly to the bed sheet or to an aesthetic reinforcing strip 50 formed from two plies of fabric, the strip 50 being sewn at its top edge 52 to the bed sheet and being tacked or sewn along its lower edge 54 to the zipper band 48 and to the bed sheet. This construction not only provides a secure connection of the pocket 30 to the bed sheet 18 but also is aesthetically pleasing.

To conceal the zipper a flap or covering 56 preferably formed from two plies of fabric is sewn to the upper zipper half 48 and to the lower edge of the reinforcing strip 50, the flap preferably being of sufficient width to overlay and conceal the entire zipper when superposed over the pocket. When lifted so as to pivot about the edge 54, the flap permits access to the zipper and thus the pocket. If a zipper or other fastening assembly is omitted, the flap in the superposed position over the pocket conceals entry to the pocket.

Figure 4:
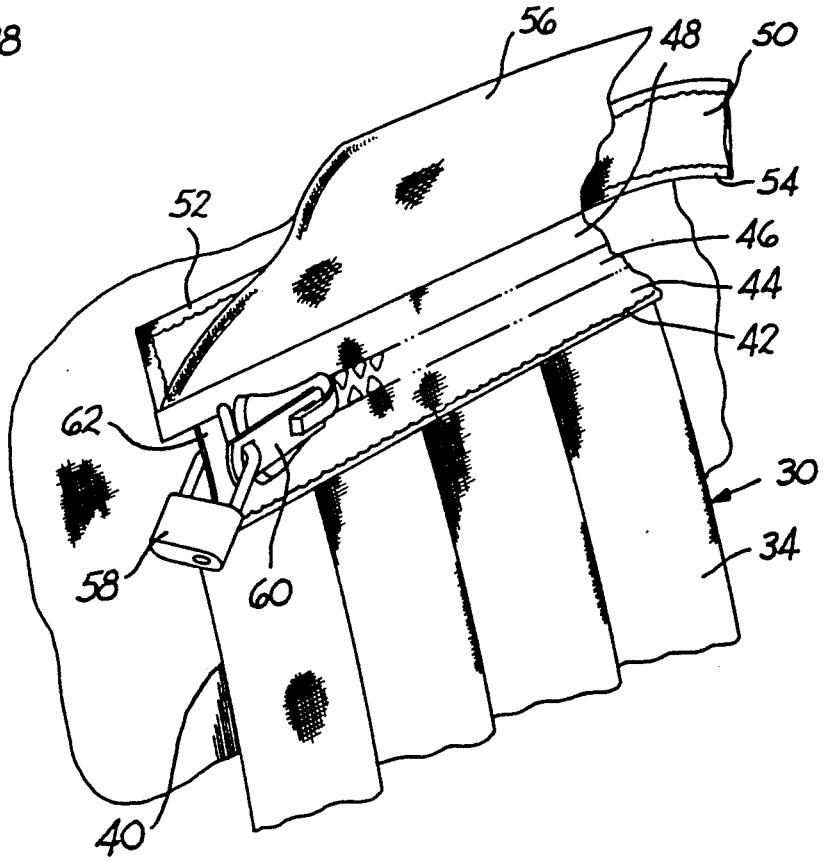
FIG. 4 is an enlarged fragmentary perspective view of a portion of the pocket illustrated on the opposite side of the sheet illustrated in FIG. 1.

To provide further security for articles stored within the pocket a small lock 58 may be connected to the zipper pull 60 and a strip of fabric 62 sewn at its ends to form a bridge across the bands 44, 48 adjacent the closed end of the zipper, i.e., the end where the pull is located when the zipper is closed. In that case, the yolk portion of the lock may pass through the conventional opening in the zipper pull 60 and as illustrated in FIG. 4, about the strip 62 to secure the zipper against opening. Thus, although fasteners other than zippers may be utilized, such as a hook and loop fastener sold under the brand name VELCRO, the zipper readily permits a locking device to be utilized. Other closure or fasteners which permit use of a lock may, of course, be substituted for the zipper.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. A bed sheet including an upper surface positionable upon the top of a mattress and having a pair of spaced apart sides depending downwardly from the upper surface for engaging side walls of the mattress, at least one storage pocket in the form of a pouch having a pair of spaced apart surfaces defining a front wall and a rear wall of said pocket, means for connecting said front and rear walls together along laterally spaced apart edges and along a lower edge, said front and rear walls being unconnected along respective top edges so that articles may be received and stored within the pocket between the front and rear walls, and means for attaching the rear wall of said pocket to a side of said sheet while permitting entry into said pouch, said storage pocket including fastener means providing a closure for selectively fastening the front and rear walls at the top edges, said fastener means comprising two selectively interlockable portions, means for connecting one of said portions to said front wall, and means for connecting the other of said portions to said rear wall, said bed sheet further including a flat disposed above said top edges and pivotable to overlay and conceal said fastener means.

2. A bed sheet as recited in claim 1, wherein said front wall comprises a first ply of fabric and said second wall comprises pleated fabric material.

3. A bed sheet as recited in claim 1, wherein said fastener means comprises a zipper having two selectively interlockable portions.

4. A bed sheet as recited in claim 3, including locking means for locking said zipper in a closed position.

* * * * *

UNITED STATES PATENT OFFICE
CERTIFICATE OF CORRECTION

PATENT NO. :5,279,009
DATED January 18, 1994
INVENTOR(S) : David L. Putka, Jr.

It is certified that error appears in the above-identified patent and that said Letters Patent is hereby corrected as shown below:

Column 4, line 12, "flat" should be -- flap--

Signed and Sealed this

Twenty-fourth Day of May, 1994

Bruce Lehman

*Attest:*

BRUCE LEHMAN

*Attesting Officer*

*Commissioner of Patents and Trademarks*